US007096982B2

(12) United States Patent
McKay et al.

(10) Patent No.: US 7,096,982 B2
(45) Date of Patent: Aug. 29, 2006

(54) DRILL SHOE

(75) Inventors: David McKay, Stonehaven (GB); David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 80 days.

(21) Appl. No.: 10/788,976

(22) Filed: Feb. 27, 2004

(65) Prior Publication Data

US 2004/0226751 A1 Nov. 18, 2004

Related U.S. Application Data

(60) Provisional application No. 60/450,432, filed on Feb. 27, 2003.

(51) Int. Cl.
*E21B 10/20* (2006.01)

(52) U.S. Cl. ..... 175/412; 175/413; 166/316

(58) Field of Classification Search ..... 166/316, 166/317, 321, 325, 326, 332.1, 334.1; 175/412, 175/413

See application file for complete search history.

(56) References Cited

U.S. PATENT DOCUMENTS

| | | | |
|---|---|---|---|
| 1,185,582 | A | 5/1916 | Bignell |
| 1,301,285 | A | 4/1919 | Leonard |
| 1,342,424 | A | 6/1920 | Cotten |
| 1,842,638 | A | 1/1932 | Wigle |
| 1,880,218 | A | 10/1932 | Simmons |
| 1,917,135 | A | 7/1933 | Littell |
| 2,017,451 | A | 10/1935 | Wickersham |
| 2,049,450 | A | 8/1936 | Johnson |
| 2,060,352 | A | 11/1936 | Stokes |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,610,690 | A | 9/1952 | Beatty |
| 2,621,742 | A | 12/1952 | Brown |
| 2,627,891 | A | 2/1953 | Clark |

(Continued)

FOREIGN PATENT DOCUMENTS

| | | |
|---|---|---|
| CA | 2 335 192 | 11/2001 |

(Continued)

OTHER PUBLICATIONS

Detlef Hahn, Friedhelm Makohl, and Larry Watkins, Casing-While Drilling System Reduces Hole Collapse Risks, Offshore, pp. 54, 56, and 59, Feb. 1998.

(Continued)

*Primary Examiner*—Frank S. Tsay

(57) ABSTRACT

A method and apparatus for a drilling with casing includes therewith a drill shoe configured for later drilling through thereof in situ, with cutters retainable thereon in response to the forces encountered during borehole drilling, yet moveable from the envelope through which the later drill shoe will pass when cutting through the in situ drill shoe. The drill shoe includes one or more profiles thereon, into which blades carrying the formation drilling cutters are disposed. The profiles include at least one projection thereon, which is received within a mating slot in the blades. The blades also may be configured to have opposed sections which are configured with respect to one another to have an included angle of less than ninety degrees.

43 Claims, 8 Drawing Sheets

U.S. PATENT DOCUMENTS

| | | | | |
|---|---|---|---|---|
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,193,116 | A | | 7/1965 | Kenneday et al. |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,489,220 | A | | 1/1970 | Kinley |
| 3,545,936 | A | | 12/1970 | Kilgore et al. |
| 3,552,507 | A | | 1/1971 | Brown |
| 3,552,508 | A | | 1/1971 | Brown |
| 3,552,848 | A | | 1/1971 | Van Wagner |
| 3,559,739 | A | | 2/1971 | Hutchinson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al . |
| 3,656,564 | A | | 4/1972 | Brown |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,729,057 | A | | 4/1973 | Werner |
| 3,747,675 | A | | 7/1973 | Brown |
| 3,760,894 | A | * | 9/1973 | Pitifer ..... 175/413 |
| 3,776,320 | A | | 12/1973 | Brown |
| 3,776,991 | A | | 12/1973 | Marcus |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,934,660 | A | | 1/1976 | Nelson |
| 3,945,444 | A | | 3/1976 | Knudson |
| 3,964,556 | A | | 6/1976 | Gearhart et al. |
| 3,980,143 | A | | 9/1976 | Swartz et al. |
| 4,049,066 | A | | 9/1977 | Richey |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,968 | A | | 7/1978 | Delano |
| 4,100,981 | A | | 7/1978 | Chaffin |
| 4,127,927 | A | | 12/1978 | Hauk et al. |
| 4,133,396 | A | | 1/1979 | Tschirky |
| 4,142,739 | A | | 3/1979 | Billingsley |
| 4,173,457 | A | | 11/1979 | Smith |
| 4,175,619 | A | | 11/1979 | Davis |
| 4,186,628 | A | | 2/1980 | Bonnice |
| 4,189,185 | A | | 2/1980 | Kammerer, Jr. et al. |
| 4,194,383 | A | | 3/1980 | Huzyak |
| 4,221,269 | A | | 9/1980 | Hudson |
| 4,227,197 | A | | 10/1980 | Nimmo et al. |
| 4,241,878 | A | | 12/1980 | Underwood |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,280,380 | A | | 7/1981 | Eshghy |
| 4,281,722 | A | | 8/1981 | Tucker et al. |
| 4,287,949 | A | | 9/1981 | Lindsey, Jr. |
| 4,311,195 | A | | 1/1982 | Mullins, II |
| 4,315,553 | A | | 2/1982 | Stallings |
| 4,320,915 | A | | 3/1982 | Abbott et al. |
| 4,384,627 | A | | 5/1983 | Ramirez-Jauregui |
| 4,392,534 | A | | 7/1983 | Miida |
| 4,396,076 | A | | 8/1983 | Inoue |
| 4,407,378 | A | | 10/1983 | Thomas |
| 4,408,669 | A | | 10/1983 | Wiredal |
| 4,413,682 | A | | 11/1983 | Callihan et al. |
| 4,427,063 | A | | 1/1984 | Skinner |
| 4,437,363 | A | | 3/1984 | Haynes |
| 4,440,220 | A | | 4/1984 | McArthur |
| 4,445,734 | A | | 5/1984 | Cunningham |
| 4,446,745 | A | | 5/1984 | Stone et al. |
| 4,449,596 | A | | 5/1984 | Boyadjieff |
| 4,460,053 | A | | 7/1984 | Jurgens et al. |
| 4,463,814 | A | | 8/1984 | Horstmeyer et al. |
| 4,466,498 | A | | 8/1984 | Bardwell |
| 4,470,470 | A | | 9/1984 | Takano |
| 4,472,002 | A | | 9/1984 | Beney et al. |
| 4,474,243 | A | | 10/1984 | Gaines |
| 4,483,399 | A | | 11/1984 | Colgate |
| 4,494,424 | A | | 1/1985 | Bates |
| 4,529,045 | A | | 7/1985 | Boyadjieff et al. |
| 4,544,041 | A | | 10/1985 | Rinaldi |
| 4,545,443 | A | | 10/1985 | Wiredal |
| 4,570,706 | A | | 2/1986 | Pugnet |
| 4,580,631 | A | | 4/1986 | Baugh |
| 4,583,603 | A | | 4/1986 | Dorleans et al. |
| 4,589,495 | A | | 5/1986 | Langer et al. |
| 4,592,125 | A | | 6/1986 | Skene |
| 4,595,058 | A | | 6/1986 | Nations |
| 4,604,724 | A | | 8/1986 | Shaginian et al. |
| 4,604,818 | A | | 8/1986 | Inoue |
| 4,605,077 | A | | 8/1986 | Boyadjieff |
| 4,605,268 | A | | 8/1986 | Meador |
| 4,620,600 | A | | 11/1986 | Persson |
| 4,625,796 | A | | 12/1986 | Boyadjieff |
| 4,630,691 | A | | 12/1986 | Hooper |
| 4,646,827 | A | | 3/1987 | Cobb |
| 4,649,777 | A | | 3/1987 | Buck |

4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,312 A 6/1987 Mosing et al.
4,681,158 A 7/1987 Pennison
4,683,962 A 8/1987 True
4,686,873 A 8/1987 Lang et al.
4,691,587 A 9/1987 Farrand et al.
4,699,224 A 10/1987 Burton
4,709,599 A 12/1987 Buck
4,709,766 A 12/1987 Boyadjieff
4,735,270 A 4/1988 Fenyvesi
4,738,145 A 4/1988 Vincent et al.
4,742,876 A 5/1988 Barthelemy et al.
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,495 A 3/1989 Leach
4,825,947 A 5/1989 Mikolajczyk
4,832,552 A 5/1989 Skelly
4,836,064 A 6/1989 Slator
4,836,299 A 6/1989 Bodine
4,838,366 A * 6/1989 Jones ..... 175/426
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,901,069 A 2/1990 Veneruso
4,904,119 A 2/1990 Legendre et al.
4,921,386 A 5/1990 McArthur
4,936,382 A 6/1990 Thomas
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,027,914 A * 7/1991 Wilson ..... 175/406
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,069,297 A 12/1991 Krueger
5,074,366 A 12/1991 Karlsson et al.
5,109,924 A 5/1992 Jurgens et al.
5,111,893 A 5/1992 Kvello-Aune
5,127,482 A * 7/1992 Rector, Jr. ..... 175/321
5,141,063 A 8/1992 Quesenbury
RE34,063 E 9/1992 Vincent et al.
5,148,875 A 9/1992 Karlsson et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller et al.
5,186,265 A 2/1993 Henson et al.
5,191,932 A 3/1993 Seefried et al.
5,191,939 A 3/1993 Stokley
5,197,553 A 3/1993 Leturno
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,839 A 4/1994 Kalsi et al.
5,318,122 A 6/1994 Murray et al.
5,322,127 A 6/1994 McNair et al.
5,332,043 A 7/1994 Ferguson
5,332,048 A 7/1994 Underwood et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III et al.
5,458,209 A 10/1995 Hayes et al.
5,472,057 A 12/1995 Winfree
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,679 A 9/1996 Thorp
5,560,437 A 10/1996 Dickel et al.
5,560,440 A 10/1996 Tibbitts
5,575,344 A 11/1996 Wireman
5,582,259 A 12/1996 Barr
5,584,343 A 12/1996 Coone
5,613,567 A 3/1997 Hudson
5,615,747 A 4/1997 Vail, III
5,645,131 A 7/1997 Trevisani
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes 5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,791,410 A 8/1998 Castille et al.
5,803,191 A 9/1998 Mackintosh
5,803,666 A 9/1998 Keller
5,826,651 A 10/1998 Lee et al.
5,828,003 A 10/1998 Thomeer et al.
5,829,520 A 11/1998 Johnson
5,833,002 A 11/1998 Holcombe
5,839,330 A 11/1998 Stokka
5,839,515 A 11/1998 Yuan et al.
5,839,519 A 11/1998 Spedale, Jr.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,957,225 A 9/1999 Sinor
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A * 5/2000 Strong et al. ..... 175/402
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,170,573 B1 1/2001 Brunet et al.
6,172,010 B1 1/2001 Argillier et al.
6,173,777 B1 1/2001 Mullins
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,349,764 B1 2/2002 Adams et al.
6,357,485 B1 3/2002 Quigley et al.
6,359,569 B1 3/2002 Beck et al.
6,360,633 B1 3/2002 Pietras
6,367,566 B1 4/2002 Hill
6,371,203 B1 4/2002 Frank et al.
6,374,506 B1 4/2002 Schuttle et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,536,520 B1 3/2003 Snider et al.
6,536,522 B1 3/2003 Birckhead et al.
6,536,993 B1 3/2003 Strong et al.
6,543,552 B1 4/2003 Metcalfe et al.
6,547,017 B1 4/2003 Vail, III
6,554,064 B1 4/2003 Restarick et al.
6,585,040 B1 7/2003 Hanton et al.
6,591,471 B1 7/2003 Hollingsworth et al.
6,634,430 B1 10/2003 Dawson et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,688,394 B1 2/2004 Ayling
6,691,801 B1 2/2004 Juhasz et al.
6,698,595 B1 3/2004 Norell et al.
6,702,040 B1 3/2004 Sensenig
6,708,769 B1 3/2004 Haugen et al.
6,725,924 B1 4/2004 Davidson et al.
6,725,938 B1 4/2004 Pietras
6,742,596 B1 6/2004 Haugen
6,742,606 B1 6/2004 Metcalfe et al.
6,745,834 B1 6/2004 Davis et al.
6,752,211 B1 6/2004 Dewey et al.
6,840,322 B1 1/2005 Haynes
6,848,517 B1 2/2005 Wardley
6,854,533 B1 2/2005 Galloway

| | | | |
|---|---|---|---|
| 6,857,486 | B1 | 2/2005 | Chitwood et al. |
| 6,857,487 | B1 | 2/2005 | Galloway et al. |
| 2001/0042625 | A1 | 11/2001 | Appleton |
| 2002/0040787 | A1 | 4/2002 | Cook et al. |
| 2002/0066556 | A1 | 6/2002 | Goode et al. |
| 2002/0108748 | A1 | 8/2002 | Keyes |
| 2002/0189863 | A1 | 12/2002 | Wardley |
| 2003/0029641 | A1 | 2/2003 | Meehan |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164250 | A1 | 9/2003 | Wardley |
| 2003/0164251 | A1 | 9/2003 | Tulloch |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent e tal. |
| 2004/0011534 | A1 | 1/2004 | Simonds et al. |
| 2004/0016575 | A1 | 1/2004 | Shahin et al. |
| 2004/0060697 | A1 | 4/2004 | Tilton et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | WO 00/11311 | 3/2000 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 448 304 | 9/1976 |
| GB | 1 459 661 | 4/1977 |
| GB | 1 582 392 | 1/1981 |
| GB | 2 053 088 | 2/1981 |
| GB | 2 115 940 | 9/1983 |
| GB | 2170528 | 8/1986 |
| GB | 2 201 912 | 9/1988 |
| GB | 2 216 926 | 10/1989 |
| GB | 2 224 481 | 9/1990 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 333 542 | 7/1999 |
| GB | 2 335 217 | 9/1999 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 765 | 9/2002 |
| GB | 2 382 361 | 5/2003 |
| GB | 2381809 | 5/2003 |
| RU | 1618870 | 1/1991 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |

| | | |
|---|---|---|
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 790 386 | 8/1997 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 99/65713 | 12/1999 |
| WO | WO 00/05483 | 2/2000 |
| WO | WO 00/08293 | 2/2000 |
| WO | WO 00/11309 | 3/2000 |
| WO | WO 00/11310 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/44601 | 6/2002 |
| WO | WO 02/081863 | 10/2002 |
| WO | WO 02/086287 | 10/2002 |
| WO | WO 03/074836 | 9/2003 |
| WO | WO 03/087525 | 10/2003 |

OTHER PUBLICATIONS

Tommy Warren, SPE, Bruce Houtchens, SPE, Garret Madell, SPE, Dircectional Drilling With Casing, SPE/IADC 79914, Tesco Corporation, SPE/IADC Drilling Conference 2003.

LaFleur Petroleum Services, Inc., "Autoseal Circulating Head," Engineering Manufacture, 1992, 11 Pages.

Valves Wellhead Equipment Safety Systems, W-K-M-Division, ACF Industries, Catalog 80, 1980, 5 Pages.

Canrig Top Drive Drilling Systems, Harts Petroleum Engineer International, Feb. 1997, 2 Pages.

Mike Killalea, Portalbe Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Hahn, et al., "Simultaneous Drill and Case Technology—Case Histories, Status and Options for Further Development, " Society of Petroleum Engineers, IADC/SPE Drilling Conference, New Orleans, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" World Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/795,129, filed Mar. 5, 2004.

U.S. Appl. No. 10/794,790, filed Mar. 5, 2004.

U.S. Appl. No. 10/162,302, filed Jun. 4, 2004.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

U.S. Appl. No. 10/618,093.

U.S. Appl. No. 10/189,570.

Tarr, et al., "Casing-while-Drilling: The Next Step Change In Well Construcction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Cost By 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp 1-13.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling, " World Oil, Sep. 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000 pp 1-11.

Warren, et al., "Drilling Technology: Part I—Casing Drilling With Directional Steering In The U.S. Gulf Of Mexico," Offshore, Jan. 2001, pp. 50-52.

Warren, et al., "Drilling Technology: Part II—Casing Drilling With Directional Steering In The Gulf Of Mexico," Offshore, Feb. 2001, pp. 40-42.

Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-6.
Coats, et al., "The Hybrid Drilling System: Incorporating Composite Coiled Tubing And Hydraulic Workover Technologies Into One Integrated Drilling System, " IADC/SPE Paper 74538, IADC/SPE Drilling Conference, Feb. 26-28, 2002, pp 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the-Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
International Search Report dated Jul. 31, 2001, for application serial No. PCT/GB01/01506.
PCT Search Report, International Application No. PCT/US2004/005983, dated Jun. 15, 2004.
PCT Search Report dated Jul. 19, 2001, for application serial No. PCT/GB01/01512.

* cited by examiner

DRILL SHOE

CROSS REFERENCE TO RELATED APPLICATION

This application claims benefit of co-pending U.S. Provisional Patent Application Ser. No. 60/450,432, filed on Feb. 27, 2003, which application is herein incorporated by reference in its entirety.

BACKGROUND OF THE INVENTION

1. Field of the Invention

Embodiments of the present invention generally relate to the field of well drilling, particularly to the field of well drilling for the extraction of hydrocarbons from sub-surface formations, wherein the drill string is used as the well casing.

2. Description of the Related Art

The drilling of wells to recover hydrocarbons from sub-surface formations is typically accomplished by directing a rotatable drilling element, such as a drill bit, into the earth on the end of tubing known as a "drill string" through which drilling mud is directed to cool and clean the drilling face of the drill bit and remove drilled material or cuttings from the borehole as it is drilled. After the borehole has been drilled or bored to its desired depth and location, the borehole is typically cased, i.e., metal tubing is located along the length of the borehole and cemented in place to isolate the borehole from the surrounding earth, prevent the formation from caving into the borehole, and to isolate the earth formations from one another. The casing is then perforated at specific locations where hydrocarbons are expected to be found, to enable their recovery through the borehole.

It is known to use casing as the drill string, and, when drilling is completed to a desired depth, to cement the casing in place and thereby eliminate the need to remove the drill string from the borehole. However, when casing is used in place of the drill string, any equipment or tooling used in the drilling of the well must be removed from the interior of the casing to allow an additional, smaller diameter casing and drill bit to drill the borehole further into the earth. Thus, the drill bit or drill shoe located at the end of the drill string must be eliminated as an obstacle, without pulling the casing from the borehole. Removal of the drill shoe is typically accomplished by drilling through the drill shoe with a second drill shoe or drill bit extended into the previously cemented casing, and thence into the earth beyond the just drilled drill shoe. Thus the drill shoe needs to be configured of a drillable material, which limits the loading which can be placed on the drill shoe during drilling and thus limits the efficiency of drilling with the drillable drill shoe. Typically a "drillable" drill shoe is configured of a relatively soft metal, such as aluminum, with relatively hard inserts of materials such as synthetic diamond located thereon to serve as the cutting material. Additionally, although the main body of the drillable drill shoe is configured of a readily drilled material, the hard cutters of the drill shoe tend to cause rapid wear and physical damage to the drill shoe being used to drill through the previous drill shoe, thus reducing the life of the drill bit, and thus the depth of formation the drill shoe can penetrate before it too must be drilled through by an additional drill shoe directed through the casing.

It is also known to provide a drill shoe having a relatively soft metal body, within which a plurality of stronger metal blades are received, upon which blades are supplied the cutters for cutting into the earth as the borehole progresses and which blades may be moved out of the area through which the drill shoe is drilled and subsequent casing penetrates, as is disclosed in U.S. Pat. No. 6,443,247, assigned to the assignee of the present invention and incorporated by reference herein in its entirety. This drill shoe includes an integral piston assembly therein, which, upon actuation by a drilling operator, pushes through the drill shoe and physically presses the harder metal blades, with the cutters thereon, into the annular area and/or the adjacent formation and out of the area through which the next drill shoe will pass. Thereafter, an additional drill shoe is passed down the existing casing to remove the remaining, relatively soft, metal mass of the drill shoe, and into the formation beyond the just drilled through drill shoe. Although this drill shoe configuration solves the problem encountered when the drill shoe would otherwise need to engage and grind up hard metal parts, the drill shoes still suffer from limited lifetimes because the blades will extrude or otherwise become separated from the relatively soft metal body of the drill shoe if the loading thereon exceeds a certain threshold. Thus, although this style of drill shoe has gained a high degree of commercial acceptance, the capability of the drill shoe remains limited.

SUMMARY OF THE INVENTION

The present invention generally provides methods and apparatus for drilling of boreholes, wherein the drill string is used as the casing for the borehole, wherein the drill shoe used for drilling the borehole includes an integral displacement element whereby the cutting elements of the drill shoe are displaceable into the formation surrounding the drill shoe when the well is completed. The drill shoe includes one or more blades having cutters thereon, and each of the blades includes an engagement profile for secure engagement with the body of the drill shoe during drilling operation yet is readily deformed to be embedded into the formation adjacent the drill shoe when drilling is completed.

In one embodiment, the blades include an outer axial section, a transverse section, and a generally axial base section that are received in a continuous slot formed within the body of the drill shoe. The slot and the blade include complementary profiles for maintaining the blades in position against the loading of the blades caused by the engagement thereof with the formation being drilled, while allowing the blades to be displaced into the formation after drilling is completed.

To enable displacement of the blades into the formation, the drill shoe preferably includes a passageway therein through which the drilling mud is flowed, and which is selectively blocked while the drilling mud is continued to be pumped into the drill string. The blocking of the mud passages completes a piston structure, which is actuated through the drill shoe and thereby pushes the blades into the adjacent formation.

In another aspect, the present invention provides an earth removal apparatus comprising a first body portion and a second body portion at least partially receivable within the first body portion. A profile is formed on an outer surface of the second body portion and a cutting member is engaged with the profile, wherein the profile is adapted to maintain the cutting member on the profile during operation.

In another aspect, the present invention provides an earth removal apparatus comprising a drillable body portion and at least one profile formed on an outer surface of the drillable body portion. The at least one profile including at least two intersecting faces, wherein one of the faces includes a projection thereon. A blade is matingly engageable with the at least one profile.

In another aspect, the present invention provides a drill bit comprising a first body portion and a drillable second body portion. At least one profile is formed integral with at least one of the first body portion and the drillable second body portion, the at least one profile having at least two opposed segments having a discernable orientation. A cutting member is received in the at least one profile and having the discernable orientation and the discernable orientation including an included angle between the opposed segments of less than ninety degrees.

In another aspect, the present invention provides a method of drilling with casing, wherein a drillable drill bit is provided, comprising providing a drill bit support at a lower end of the casing, locating a drillable body portion within the drill bit support, and providing a blade receiving member integral with at least one of the drill bit support and the body portion. The receiving member including a profile. The method also includes positioning a blade having a mating profile on the receiving member and using the drill bit to form a wellbore, wherein the profile is adapted to substantially maintain the blade on the blade receiving member during drilling.

In another aspect, the present invention provides a method of completing a wellbore comprising providing an earth removal apparatus at a lower of a drill string. The earth removal apparatus having a first body portion and a drillable portion disposed in the first body portion, the drillable portion including a bore. The method also includes forming the wellbore, blocking the bore from fluid communication, moving the drillable portion relative the first sleeve portion, and re-establishing fluid communication between an inner portion of the earth removal apparatus and the wellbore.

In another aspect, the present invention provides a downhole valve comprising a first body portion, a bore disposed through the first body portion, and an obstruction member retainer at least partially disposed in the bore, wherein the obstruction member retainer is adapted to cooperate with an obstruction member to provide selective fluid communication through the bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 is a sectional view of the drill shoe of FIG. 2, after the drill shoe has reached total depth and the drill shoe is prepared to be drilled through;

DETAILED DESCRIPTION OF THE PREFERRED EMBODIMENT

Figure 1:
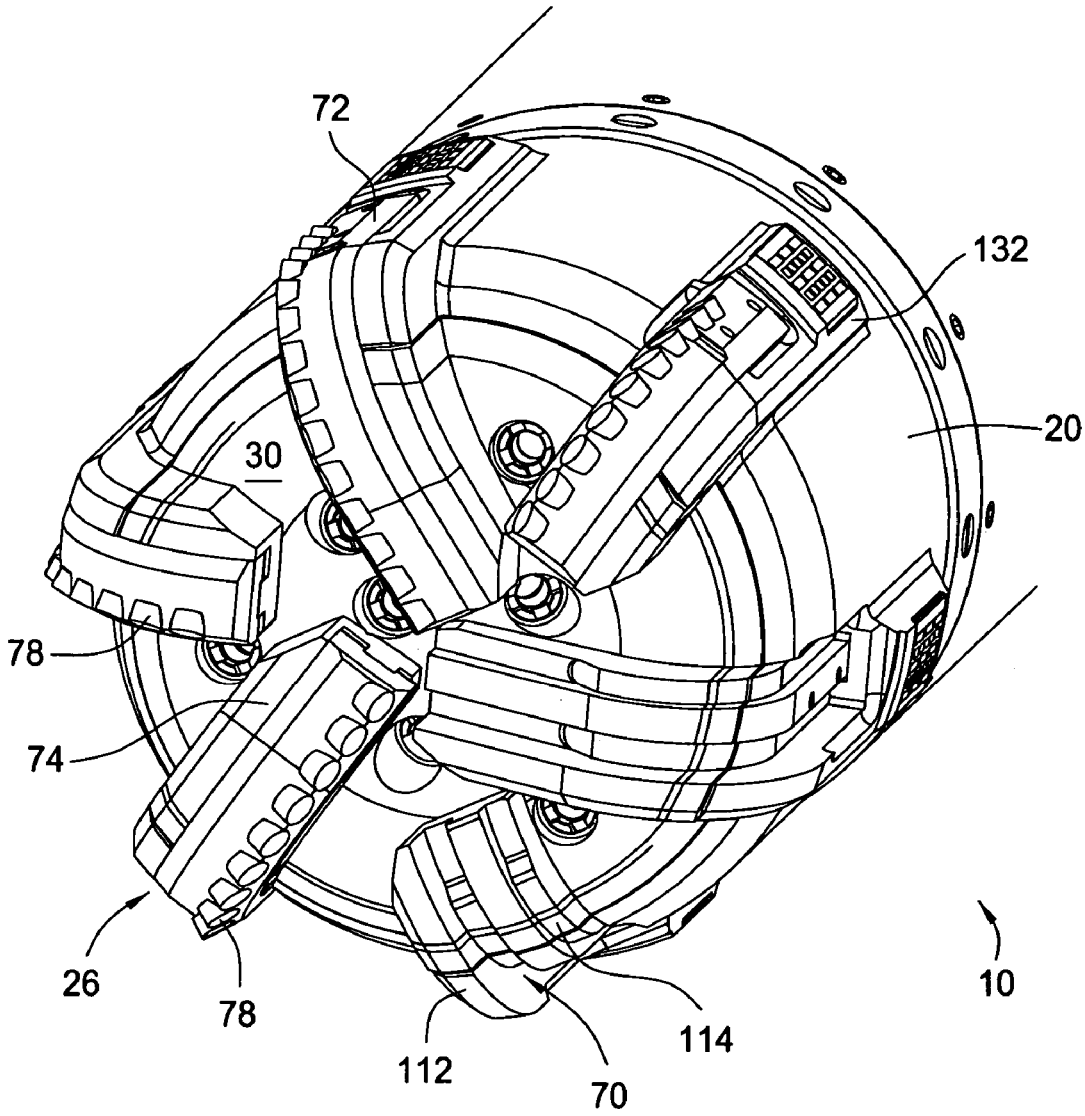
FIG. 1 is a perspective view of a drill shoe of the present invention.

Referring initially to FIG. 1, there is shown in perspective an earth removal apparatus such as a drill shoe 10 of the present invention, for placement on the end of a string of casing for drilling a borehole into the earth, primarily for the recovery or potential recovery of hydrocarbons from subsurface locations. The drill shoe 10 generally includes a support, such as a sleeve portion 20, into which is received a drillable member, such as a body portion 30, and over which are secured a plurality of cutting members or blades 26 (only four of a total of six to be so located) in notches 70 formed on the exterior of the drill shoe 10. The drill shoe 10 is specifically configured to enable the drilling of a borehole with the drill shoe 10, with subsequent cementing of the casing into the borehole, and then subsequent drilling through of the drill shoe 10 with a subsequent drill shoe 10.

Figure 2:
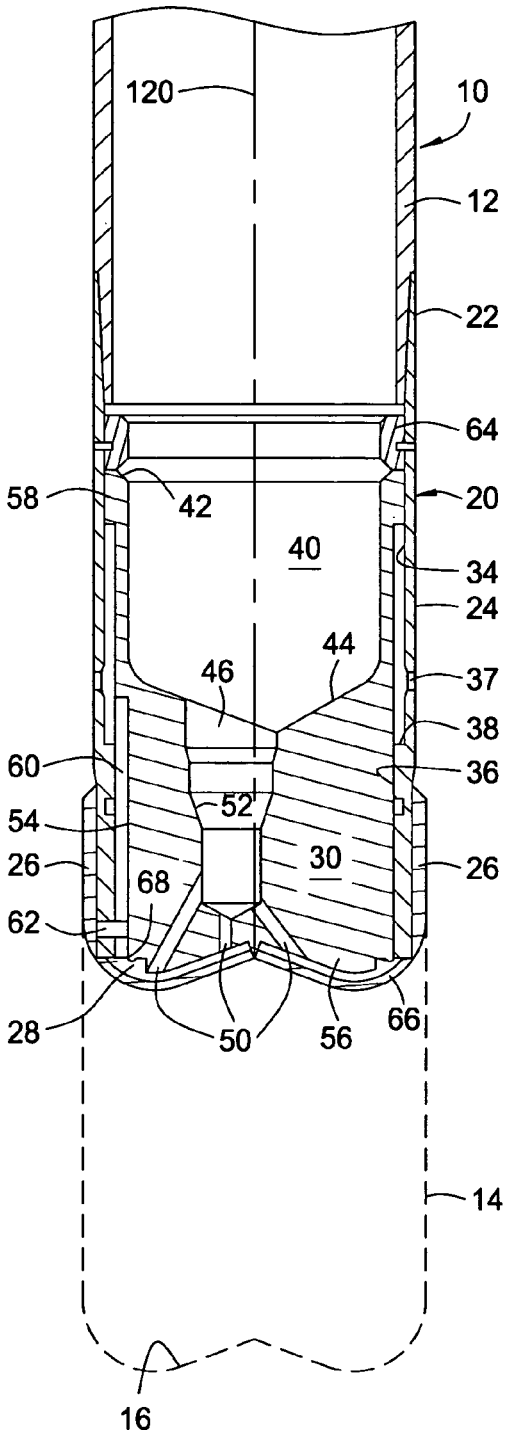
FIG. 2 is a sectional view of the drill shoe of FIG. 1 in a downhole location.
Figure 3:
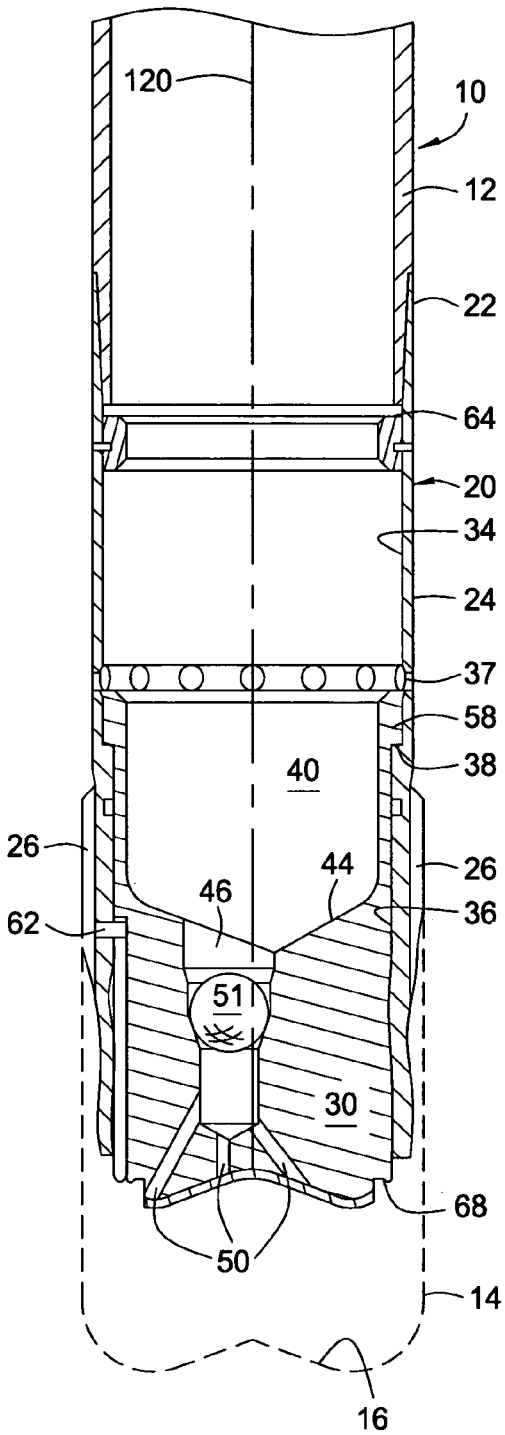

Referring now to FIGS. 2 and 3, there is shown, in cross section, the drill shoe 10 of the present invention, suspended upon casing 12 located within a borehole 14, which casing 12 is rotated by a drilling table, top drive, or similar apparatus (not shown) at the earth's surface to enable the drill shoe 10 to drill or cut into the formations encountered thereby and thus form the borehole 14. The drill shoe 10 generally includes an outer, tubular sleeve 20 upon which a plurality of blades 26 are secured, and within which is positioned a body portion 30 of a drillable material, such as aluminum. In operation, the body portion 30 provides rigidity to prevent deformation of the sleeve 20 and maintain the drill shoe 10 on a threaded connection on the lower most extension of the casing in the wellbore as drilling operations are carried out, and also provides an extrusion element which may be pushed through the sleeve 20 and thereby push the blades 26 into the adjacent formation in the annular area and/or sides of the borehole 14 to enable drilling through of the drill shoe 10 during subsequent operations in the borehole 14.

Sleeve 20 is generally configured as a tubular or cylindrical element, and includes a first, threaded end 22 for threaded receipt upon the lowermost extension of the casing 12, an outer, cylindrical face 24 upon which a plurality of blades 26 (preferably 6) are disposed, and a lower open end 28. The inner cylindrical face of sleeve 20 includes a first, major diameter bore 34 extending from first end 22, and a second smaller diameter bore 36 extending from a ledge 38 formed at the intersection of these two, collinear, bores. Within sleeve 20 is received the body portion 30 of a drillable material, such as aluminum, which forms a mass within the sleeve to maintain the shape of sleeve 20 as the drill shoe 10 is pushed against the bottom 16 of the borehole 14 and rotated. Sleeve 20 further includes a plurality of mud vents 37, disposed radially through the sleeve 20 at the major diameter bore 34.

Body portion 30 is a generally right circular mass of drillable material, having features formed therein such as by machining, to provide a mass of material to back up the relatively thin wall of the sleeve 20 during drilling, to enable the extrusion of the body portion 30 through any potentially borehole interfering sections of the sleeve 20 and the blades 26 when the drilling is completed with the drill shoe 10, and to provide a readily drillable material for removal of the mass from the borehole 14. Body portion 30 generally includes a main counterbore 40 extending inwardly of the first end 42 thereof, and ending at a generally conically concave base 44 from which a mud bore 46 extends inwardly of the backup portion of body portion forming backup mass to limit the deformation of the sleeve 20 and the blades 26 during drilling operations. Mud bore 46 splits into a plurality of mud passages 50, which terminate at the lower surface of the body portion 30. Mud bore 46 also includes a tapered seat portion 52, into which a ball 51 (FIG. 2) may be seated, as will be further described herein. The outer surface of body portion 30 includes a generally right circular outer face 54, and an end portion 56 which is profiled and machined to receive a portion of the blades 26 therein, as will be described further herein. Outer face 54 includes, at the opening of the counterbore 40, a outwardly extending lip 58 which sealingly, or at least is substantially closely, fits to the inner face of major diameter bore 34, as well as at least one axial slot 60, extending along the outer face 54 from the end portion 56. A pin 62 is secured within sleeve 20 and extends into slot 60, and serves to prevent rotation of the body portion 30 within sleeve 20 when a different drill bit introduced down the casing interior drills the body portion 30 out.

To retain the body portion 30 within sleeve 20, the sleeve 20 includes a retainer ring 64, located within major diameter bore 34 generally above the body portion 30 and secured thereto with pins or the like, which prevents retraction of the body portion 30 from the sleeve 20, and an inwardly projecting lip 66, extending inwardly at the lower open end thereof, which is received into an annular recess 68 machined or cast into the face of body portion 30 about its perimeter (best shown in FIG. 3). Lip 66 may be a continuous inward projection on the end of the sleeve 20, or may be a separate retainer ring which is affixed at its inboard end to the end of sleeve 20.

Referring again to FIG. 1, a general overview of the structure of the blades 26, as well as their attachment to the drill shoe 10, is shown. Generally, the blades 26 are received within a profile which extends along the outer surface of the sleeve 20 and the base of body portion 30. An exemplary profile is a notch 70 configured to interact with the blade 26 to keep the blade 26 in position on the sleeve 20 during drilling operation. Each blade 26 is formed of a single length of steel, or similar material having both relatively high strength, rigidity and ductility, bent to form opposed first and second linear sections 72, 74, which are interconnected by curved shoulder segment 76. A plurality of cutters 78 are located on the outer face of the blades 26, to be engaged with, and cut into, the formation as the borehole extends therein. Although six blades 6 are shown in the Figures, it is contemplated that any suitable number of blades 26 may be disposed on the drill shoe 10. For example, the drill shoe 10 may include four blades or five blades.

Figure 5:
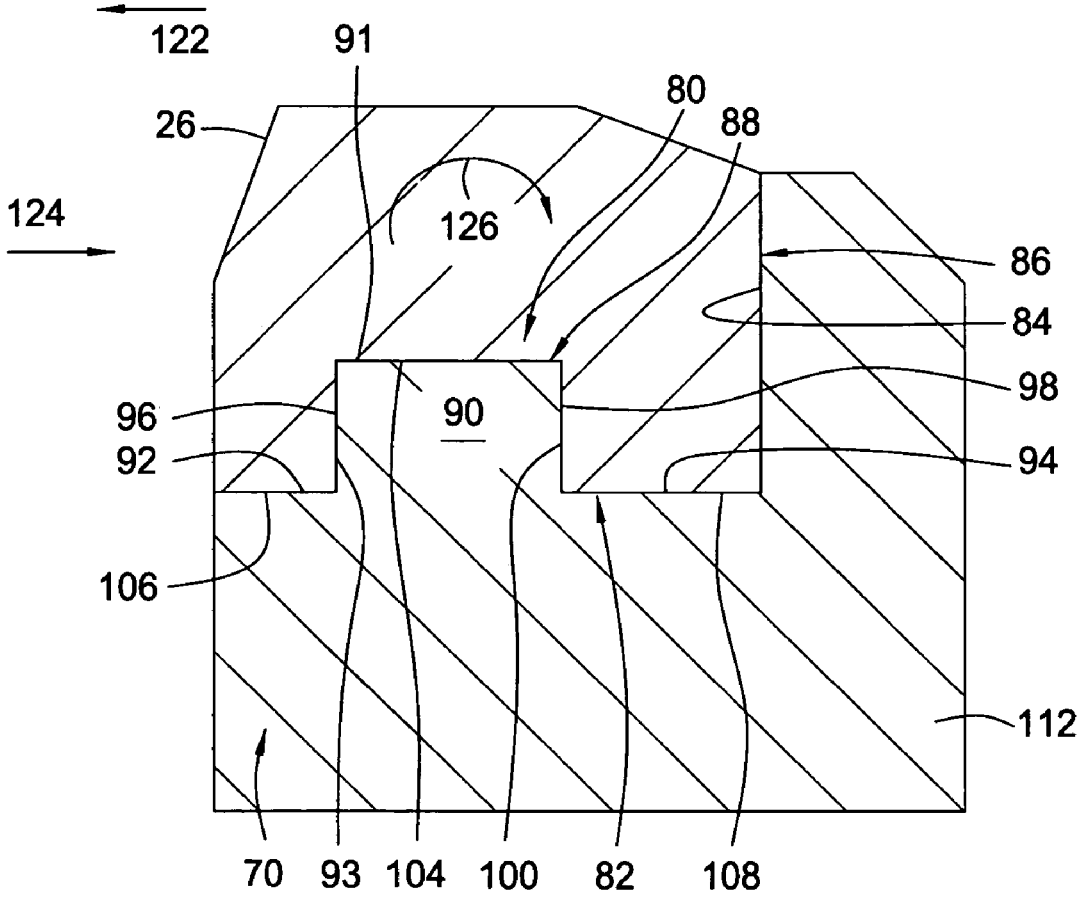
FIG. 5 is a sectional view of the blade portion disposed on the notch of the drill shoe.
Figure 6:
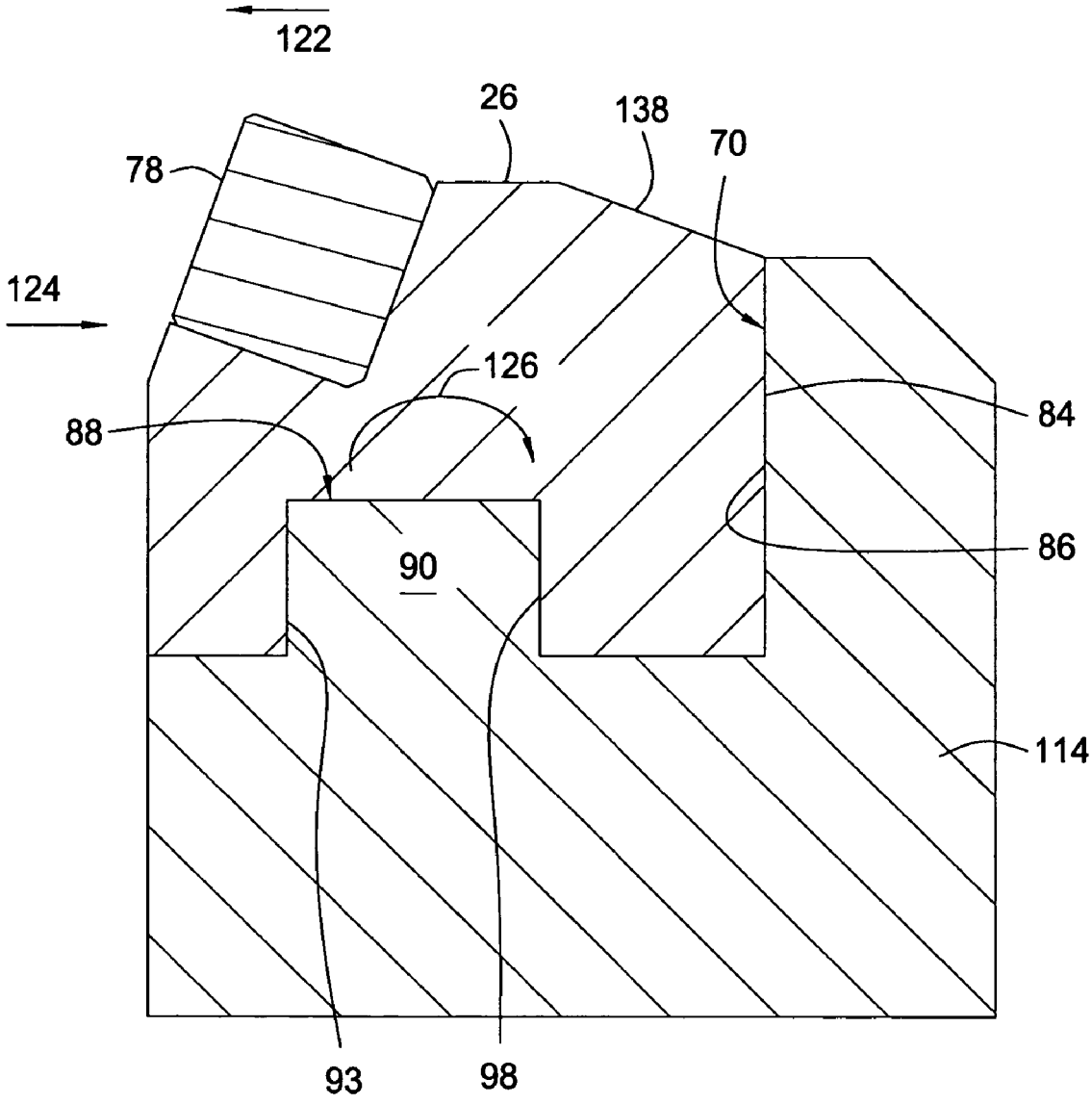
FIG. 6 is a further sectional view of the blade portion disposed on the notch of the drill shoe.

The interface and interconnection of the blade 26 and notch 70 is shown in detail in FIGS. 5 and 6, wherein the blade 26 is generally rectangular in cross section, and includes a multifaceted base 80 which contacts a multifaceted first face 82 of the notch 70, and a sidewall 84 which abuts against a second face 86 of the notch 70. Multifaceted base 80 includes a centrally located, generally rectangular, slot 88 extending therein over the length thereof, into which a mating rectangular projection 90 of the notch 70 extends, along the entire length of the blade 26. Projection 90, being generally rectangular in cross section, forms in conjunction with multifaceted first face 82 a first compression face 104 extended upwardly on projection 90, and first and second lower compression faces 106, 108, disposed to either side of first compression face 104, an anti-rotation flank 100 in facing relationship to second face 86 of notch 70, and a secondary abutment face 93, on the opposed flank of the projection from anti rotation flank 100 and generally parallel thereto and to second face 86 of the notch 70.

Referring again to FIG. 1, to create the multifaceted notch 70, a continuous groove (not shown) is cut into the outer face of both the sleeve 20 and body 30, into which preforms 112 and 114, having the specific geometry of the notch 70 provided therein, are inserted and welded into place. Alternatively, the preform 114 in body portion 30 may be created by directly molding a boss into the body portion 30 when the body portion 30 is initially configured such as by aluminum casting, and then machining the specific geometry of the notch 70 therein. Alternatively still, the preforms 112, 114 may be formed into both the sleeve 20 and the body portion 30 by machining. Additionally, the outer surface of the sleeve 20 includes stabilizers or standoffs 132, positioned at the uppermost terminus of the notch 70, having a height corresponding generally to the height of the cutters 78 on the first linear section 72 of the blades 26, to center or stabilize the drill shoe 10 in the borehole 14.

Referring now to FIGS. 5 and 6, the blade 26 includes geometry complimentary to the notch 70, such that slot 88 projecting into multifaceted base 80 creates a multi level engagement surface, including a recessed face 91 and two extended faces 92, 94, generally parallel thereto and extended therefrom by the depth of the slot 88, as well as first projecting face 96 and second projecting face 98, formed as the flanks of the slot in a facing, generally parallel relationship to one another and to the sidewall 84. The depth of slot 88 is variable, such that the slot 88 is deeper, and thus the area of faces 96 and 98 are greater, in second linear section 74 of the blade 26 which, in use, is located within the notch 70 received in the body portion 30 of the drill shoe 10. Likewise, as shown in FIG. 5, the height of sidewall 84 is increased to maintain a larger area for full depth contact between sidewall 84 and second face 86. As it is specifically contemplated that the body portion 30 is configured from an easily drillable material, which will likely have a lower shear or yield resistance than the material used for the sleeve 20, this larger area of the faces (and correspondingly of sidewall 84) helps distribute the load in the notch 70 over a greater area in the body portion 30 as compared to the sleeve 20, and thereby reduce the likelihood of plastic failure of the notch 70 as it extends in the body portion 30 under drilling conditions. As shown in FIGS. 5 and 6, the aspect ratio of the slot 88 (and correspondingly in the mating surfaces of the notch 70), and likewise of the projection 90, defined as the height of the projection (or depth of slot) to its width, ranges in the embodiment shown from slightly over 1:1 at the first linear section 72 of the blade 26, to approximately 2:1 at the second linear section 74 of the blade 26. It is contemplated that higher aspect ratios are appropriate, for example, where the blade is very large in width, i.e., the circumferential direction of the sleeve 20, for example on the order of 5 inches wide, a slot depth of only 0.010 inches may be appropriate, resulting in an aspect ratio of 0.002:1. Likewise, were the blade made relatively tall, a high aspect ratio on the order of 500:1 may be appropriate.

Received upon the outer surface of the blade 26 are a plurality of cutters 78, typically hardened synthetic diamond compacts, which are attached thereto using welding, high strength adhesives, threaded engagement into bores in the blade 26, or the like. To secure the blade 26 and fill the gaps or clearances between the blade 26 in the notch 70, adhesive or filler, such as Tubelok available from Weatherford Corporation of Houston, Tex., is applied to the blade 26 and notch 70, and the blade 26 pushed therein. It is specifically contemplated that the fit of the blade 26 in the notch 70 not be an interference fit at ambient temperatures, and that a clearance on the order of a few thousands of an inch between the slot 88 and projection 90 is allowable as long as the fit is snug.

During drilling operation, the drill shoe 10 rotates generally about axis 120 (FIG. 2) such that, as shown in FIG. 5, the blade 26 moves in the direction of arrow 122 into engagement with the formation. As a result, force will be imparted against the blade 26 as shown by arrow 124, tending to cause the blade 26 to rotate (or load in the notch 70) as shown by arrow 126. The configuration of the blade 26 and notch 70 are specifically provided to prevent such motion. Thus, as this loading occurs, sidewall 84 is pushed against second face 86 of the groove, and first projecting face 96 bears against secondary abutment face 93 of groove, to provide lateral or direct support against the primary load of the formation, simultaneously, second projecting face 98 is coupled, by the moment caused by the loading of the blade 26 at the cutters 78, against anti-rotation flank 100, and each of the faces 91, 92 and 94 of the blade 26 are loaded by the moment against their respective compression faces 104, 106 and 108, thereby preventing significant movement of the blade 26 in the notch 70. Thus, as force is imparted against the blade 26 in the direction of the arrow 126, any tipping or rotation of the blade 26 will be absorbed by the notch 70. To secure the blade 26 on the sleeve 20, the blade 26 is welded thereto at one or more locations along its length.

Figure 4:
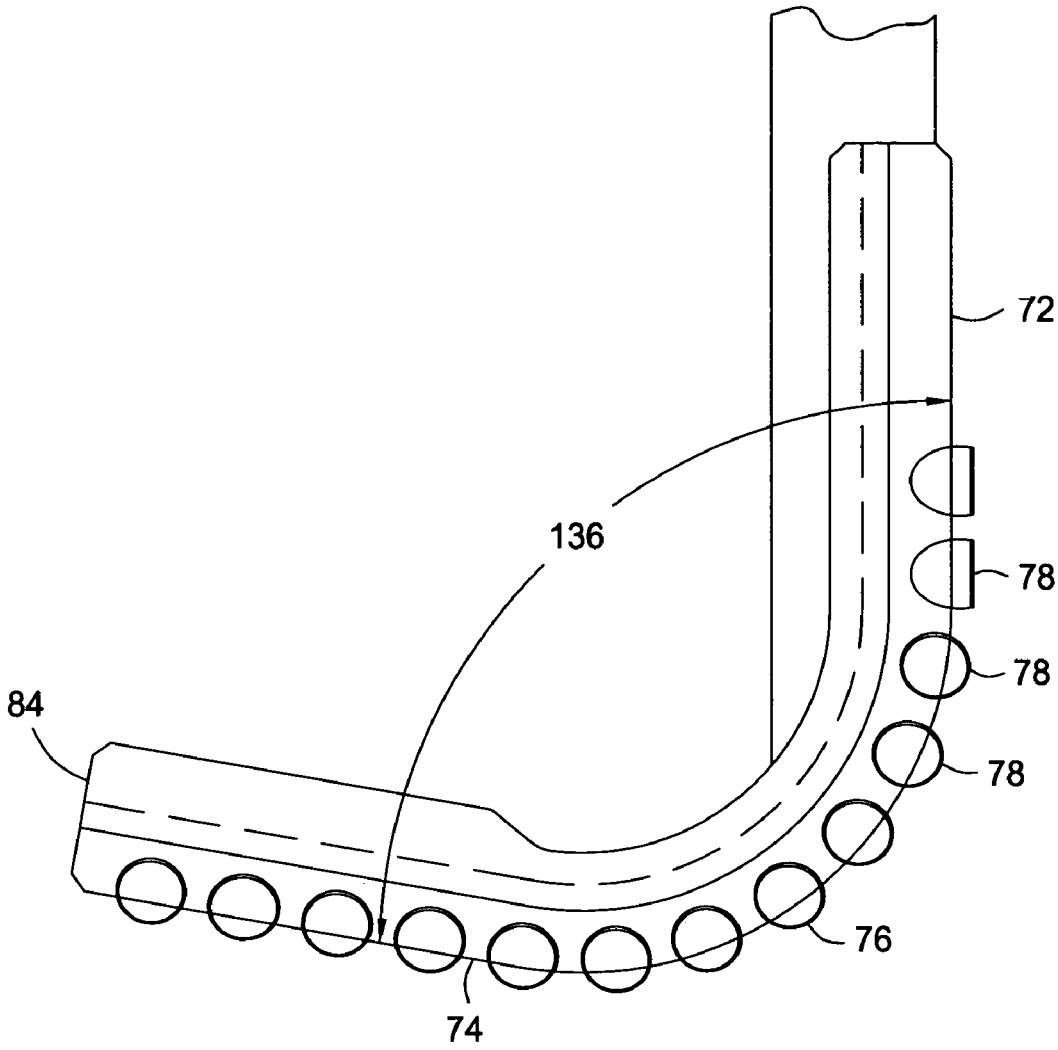
FIG. 4 is a perspective view of a blade portion of the drill shoe of FIG. 1.

The blade geometry, in addition to the blade profile helps maintain the blade 26 on the sleeve 20. During drilling operations, it is unlikely that the entire length of a blade 26 will be simultaneously engaged against the formation. Furthermore, the presence of standoffs 132 on the sidewall of the sleeve 20 limits the penetration of the cutters 78 on the first linear section 72 of the blade 26. Thus, when the drill shoe 10 is pushing against the bottom of the borehole 14, the second linear section 74 of the blade 26 will be engaged with the formation, whereas the other portions may not. Thus, force will be imparted against the second linear section 74 of the blade 26, tending to cause it to tip or rotate in the notch 70 in the direction of arrow 126 (FIG. 5). However, it can be seen from FIG. 4 that the geometry of the blade 26 results in the first linear section 72 and curved segment 76 being levers, with respect to the second linear section 74, and the placement of these portions of the blade 26 within the notch 70 will cause these portions of the blade 26, along with the structural rigidity of the blade 26, to help the blade 26 resist rotating out of the notch 70. Additionally, the included angle 136 between the two linear sections 72, 74, is preferably maintained below 90 degrees, which further enhances the likelihood of maintaining the blade 26 in the notch 70. As the outer face 138 of the blade 26 is preferably parallel with the recessed face 91 and two extended faces 92, 94 of the blade 26 which rest at compression faces 104, 106 and 108 of the notch 70, the included angle 136 is repeated between these faces as well.

Referring again to FIGS. 2 and 3, the operation of the drill shoe 10 for using the casing 12 as drill string is shown. Specifically, when the borehole 14 has reached total depth for the specific drill shoe 10 in use, which is a function of the wear of the drill shoe 10, the casing 12 is pulled upwardly in the borehole 14, to leave a space between the drill shoe 10 and the bottom of the hole 14 as shown in FIG. 2. In this position, drilling mud continues to flow down the middle of the casing 12, and thence outwardly through the mud passages 50 in the drill shoe 10 and thence to the surface through the space between the drill shoe 10 and casing 12 and the borehole 14.

Figure 7:
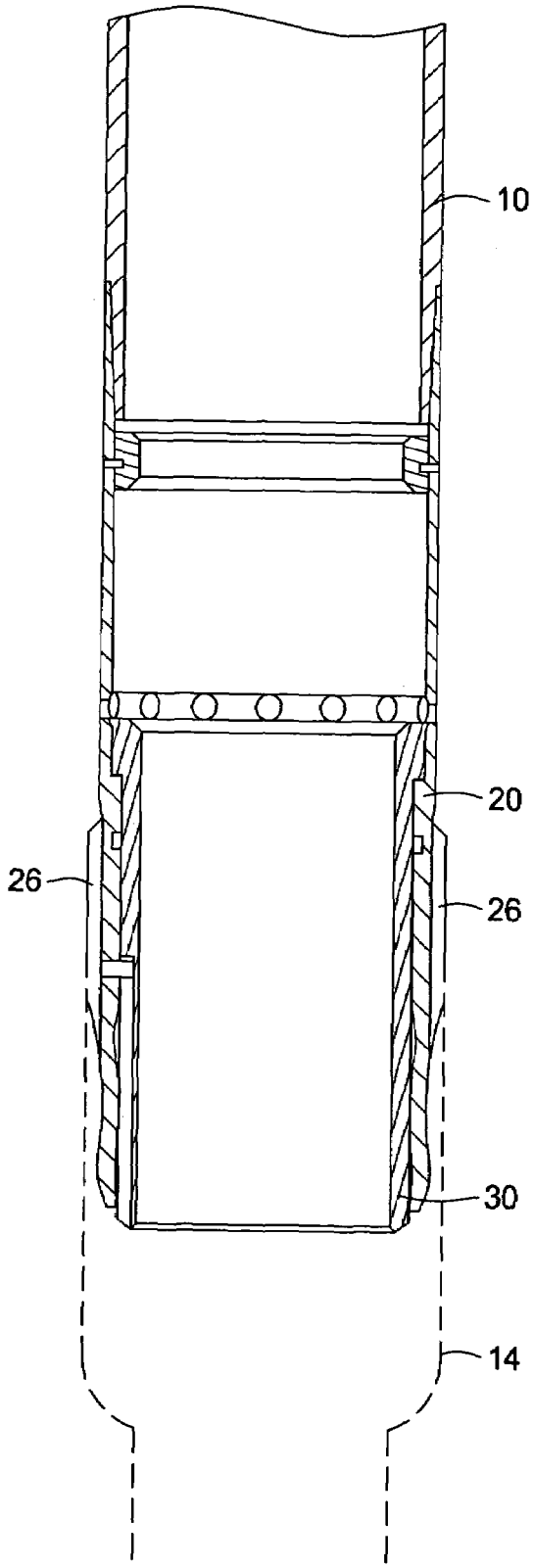
FIG. 7 is a sectional view of the drill shoe as shown in FIG. 2, after having been drilled through FIG. 8 shows another embodiment of a drill shoe according to aspects of the present invention.

To begin the operation ultimately leading to the elimination of the drill shoe 10 as an obstacle in the borehole 14, a ball 51 is dropped through the casing 12 into the mud bore 52 from a remote location, which can include the earth's surface. When the ball 51 enters the mud bore 52, it seals the mud bore 52 causing the mud to press down upon the body portion 30, and causes the body portion 30 to slide within sleeve 20 from the position of FIG. 2 and FIG. 3. As the body portion 30 begins to slide, it deforms the base of sleeve 20 outwardly, and also deforms the second section 74 about the angled portion 76 of the blade 26 such that the blades 26 are bent into a generally linear condition as shown in FIG. 3. In one embodiment, the second section 74 may be embedded within the walls of the borehole along with the likewise deformed base of the sleeve 20. In another embodiment, it may that a clearance exists between the wall of the borehole and the second section 74. Movement of the body portion 30 within the sleeve 20 to the position shown in FIG. 3 also exposes the mud vents 37 to the drilling mud, thereby providing a new path for mud flow to re-establish circulation. In this respect, the new path may be used to introduce cement into the borehole to cement the casing 10. In one embodiment, cement may be supplied through the mud vents 37 to cement at least a portion of the casing 10 into place. Additionally, re-establishing the new path also causes a pressure drop in the mud column, which indicates to the operator that the body portion 30 successfully moved within the sleeve 20 to bend the blades 26 outwardly. Thereafter, a subsequent drill bit or drill shoe is passed down the casing 12, and is engaged into body portion 30 to drill through body portion and continue the drilling of the borehole 14 to further depth as shown in FIG. 7.

Figure 8:
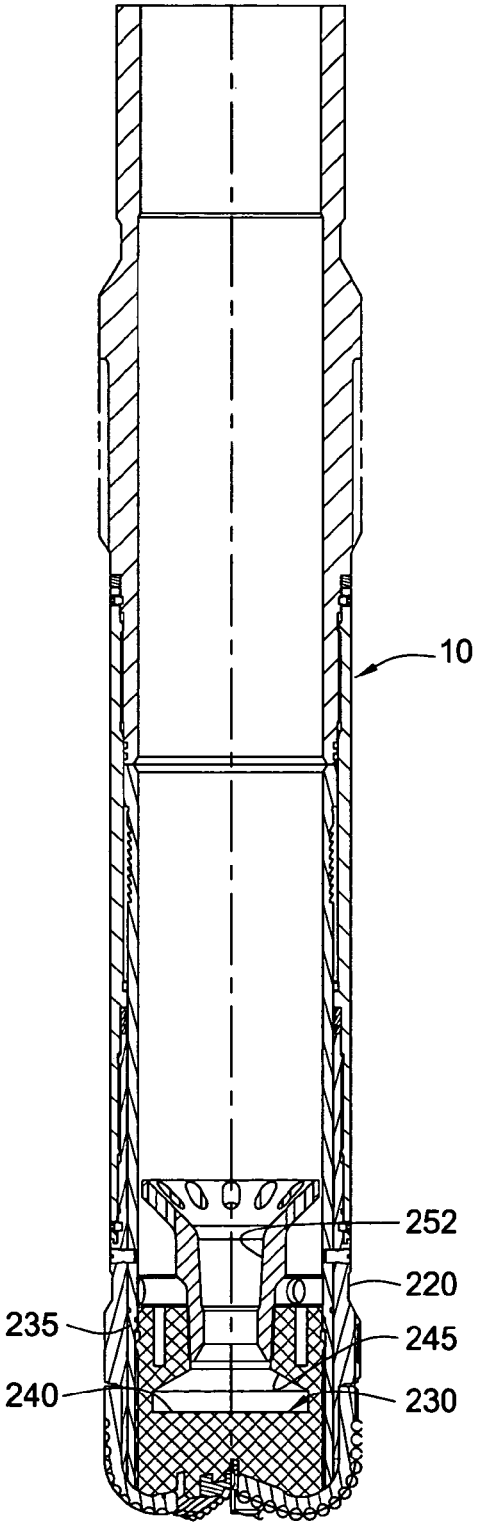

FIG. 8 presents another embodiment of the drill shoe according to aspects of the present invention. The drill shoe 10 includes a sleeve 220 having a body portion 230 disposed therein. The body portion 230 comprises a support sleeve 235 and an inner portion 240. The inner portion 240 may include components such as the ball seat 252 and the inner core 245. In one embodiment, the ball seat 252 and the inner core 245 may be two separate components, as shown in the Figure. In another embodiment, the inner portion 240, e.g., the ball seat 252 and the inner core 245, may be manufactured in one piece, as shown in FIG. 2. Preferably, the inner portion 240 comprises a drillable material such as aluminum, and the support sleeve 235 comprises steel or other composite material of sufficient strength to provide rigidity to the body portion 230.

Figure 9:
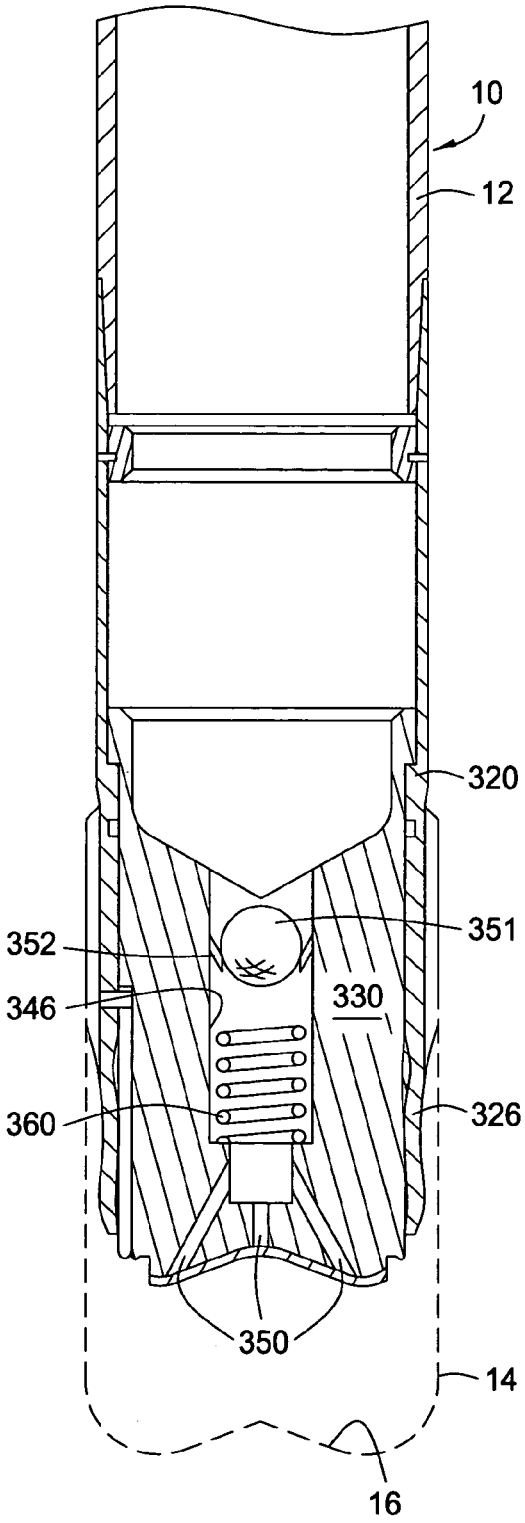
FIG. 9 shows yet another embodiment of a drill shoe according to aspects of the present invention.

FIG. 9 presents another embodiment of the drill shoe 10 according to aspects of the present invention. As shown, the drill shoe 10 provides an alternative method of re-establishing circulation. The drill shoe 10 includes a body portion 330 disposed in an outer sleeve 320. One or more blades are disposed on the outer surface of the outer sleeve 320 and the lower surface of the body portion 330. The body portion 330 includes a bore 346 which splits into one or more passages for fluid communication with the borehole 14. The bore 346 may include an obstruction member retainer for retaining an obstruction member. For example, the bore 346 may include a ball seat 352 for receiving a ball 351. Preferably, the ball seat 352 comprises a flexible material such that the ball 351 may be pumped through the ball seat 352 when a predetermined pressure is reached. The bore 346 also includes a biasing member 360 such as a spring 360 disposed below the ball seat 352. The spring 360 may be used to bias the ball 351 against the ball seat 352 to act as a valve to regulate fluid flow in the bore 346. Although a ball seat is disclosed, other types of obstruction member retainer known to a person of ordinary skill in the art are contemplated, for example, an obstruction member retainer having a seating surface for receiving an obstruction member to regulate fluid flow.

FIG. 9 shows the drill shoe 10 after drilling has completed and the body portion 330 has deformed the base of the sleeve 320 outwardly. Particularly, a ball 351 landed in the ball seat 352 to allow pressure build up, thereby causing the body portion 330 to slide downward relative to the sleeve 320. As a result, the second section of the blades is bent into a generally linear condition.

Figure 10:
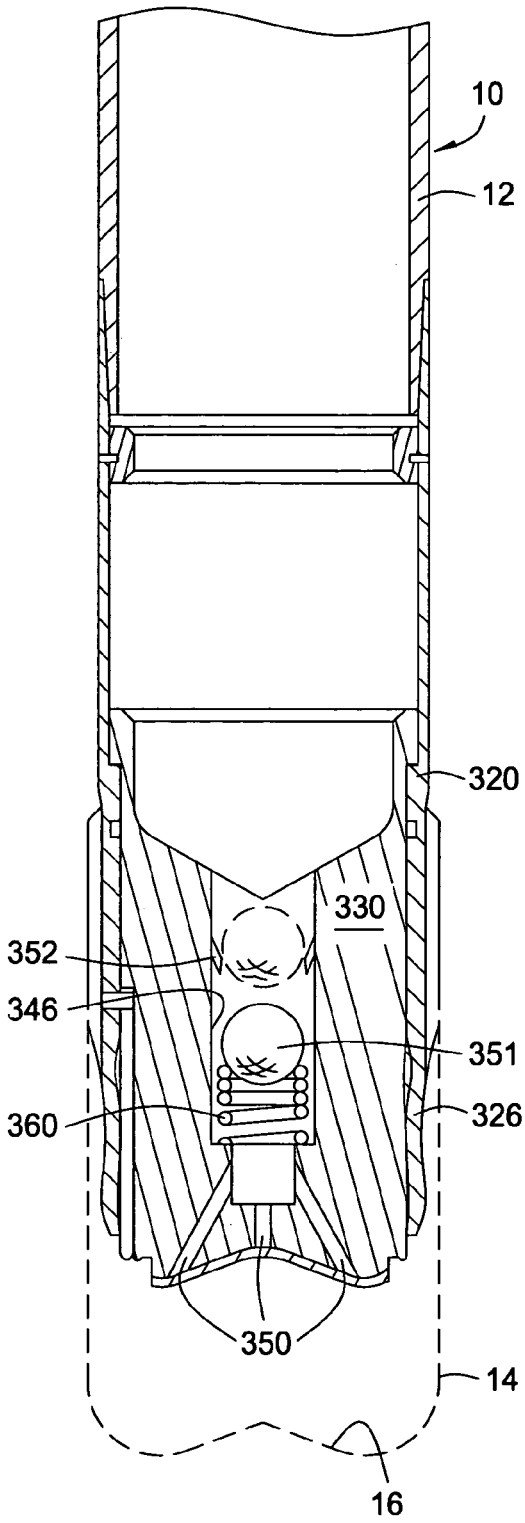
FIG. 10 shows the drill shoe of FIG. 9 after the ball has extruded though the ball seat to re-establish circulation.

To re-establish circulation, pressure above the ball 351 is increased further to pump the ball 351 to through the flexible ball seat 352, as shown in FIG. 10. The ball 351 lands on the spring 360, which biases the spring 360 against the lower portion of the ball seat 352, which acts as a second seating surface for the ball 351. In this respect, a seal is formed between the ball 351 and the ball seat 352, thereby closing off fluid communication.

When the pressure of the cement or other fluid in the casing 12 is greater than the biasing force of the spring 360, the ball 351 may be caused to disengage the ball seat 352, thereby opening up the bore 346 for fluid communication with the borehole 14. In this manner, cement may be supplied to cement the casing 12 in the borehole 14. After the cementing operation is completed, pressure in the casing 12 is relieved. In turn, the spring 360 is again allowed to bias the ball 351 against the ball seat 352, thereby closing off the bore 346 for fluid communication. In this respect, the ball 351 and the ball seat 352 may act as a check valve to prevent cement or other fluid to re-enter the casing 12.

Although the invention has been described herein with respect to a specific embodiment, these embodiments may be modified without affecting the scope of the claims herein. In particular, the groove and slot configuration may be modified. For example, the slot may be positioned in the groove and the blade may include the projection, or alternatively, several slots and mating projections may be provided.

While the foregoing is directed to embodiments of the present invention, other and further embodiments of the invention may be devised without departing from the basic scope thereof, and the scope thereof is determined by the claims that follow.

We claim:

1. An earth removal apparatus, comprising:

a first body portion;

a second body portion at least partially to receivable within the first body portion;

a profile formed on an outer surface of the second body portion; and a cutting member releasably connectable with the profile, wherein the connection is releaseable along at least two axis and the profile is adapted to maintain the cutting member on the profile during operation.

2. The earth removal apparatus of claim 1, wherein the profile comprises at least two intersecting faces, wherein one of the faces provides a support against rotation of the cutting member.

3. The earth removal apparatus of claim 1, wherein the profile substantially prevents movement of the cutting member in the profile.

4. The earth removal apparatus of claim 1, wherein the cutting member comprises a first end and a second end, wherein the second end is selectively detachable from the profile.

5. The earth removal apparatus of claim 4, wherein the second end is attached to the second body portion.

6. An earth removal apparatus, comprising:

a drillable body portion;

at least one profile formed on an outer surface of the drillable body portion, the at least one profile includes a projection formed on a portion thereof; and a blade releasably connectable with the at least one profiles wherein the connection is releasable along at least two axis.

7. The earth removal apparatus of claim 6, further comprising a sleeve disposed around a portion of the drillable body portion.

8. The earth removal apparatus of claim 7, wherein the at least one profile extends into an outer surface of the sleeve, the blade additionally received in the at least one profile in the sleeve.

9. The earth removal apparatus of claim 6, wherein the projection is rectangular in cross section, and the blade includes a slot therein for receiving the projection.

10. The earth removal apparatus of claim 6, wherein the at least one profile is machined into the drillable body portion.

11. The earth removal apparatus of claim 6, wherein the blade is bonded to the at least one profile.

12. The earth removal apparatus of claim 6, further comprising a filler disposed between the blade and the at least one profile.

13. The earth removal apparatus of claim 6, wherein the at least one profile includes opposed linear sections thereof, the linear sections offset from one another by an included angle of less than 90 degrees.

14. The earth removal apparatus of claim 6, further including a preform disposed in the drillable body portion, the preform having the at least one profile therein.

15. The earth removal apparatus of claim 6, further including a passage closure member for closing one or more passages in the drillable body portion.

16. The earth removal apparatus of claim 6, wherein the profile comprises a notch.

17. The earth removal apparatus of claim 6, further comprising a sleeve.

18. The earth removal apparatus of claim 17, wherein the drillable body portion comprises aluminum.

19. A drill bit, comprising:

a first body portion;

a drillable second body portion;

at least one profile formed integral with at least one of the first body portion and the drillable second body portion, the at least one profile having at least two opposed segments having a discernable orientation;

a cutting member received in the at least one profile and having the discernable orientation; and the discernable orientation including an included angle between the opposed segments of less than ninety degrees.

20. The drill bit of claim 19, wherein:

the cutting member includes a segmented profile having a slot therein;

the at least one profile having a projection engageable with the slot; and wherein the cutting member is positioned in the at least one profile such that the projection is received in the slot.

21. The drill bit of claim 19, wherein the at least one profile extends within the drillable second body portion and the first body portion.

22. The drill bit of claim 19, wherein the at least one profile is machined into the drillable second body portion.

23. The drill bit of claim 19, wherein the first body portion comprises a sleeve.

24. A method of drilling with casing, wherein a drillable drill bit is provided, comprising:

providing a drill bit support at a lower end of the casing;

locating a drillable body portion within the drill bit support;

providing a blade receiving member, integral with at least one of the drill bit support and the body portion, the receiving member including a profile;

positioning a blade having a mating profile on the receiving member; and using the drill bit to form a wellbore, wherein the profile is adapted to substantially maintain the blade on the blade receiving member during drilling.

25. The method of claim 24, further including configuring the blade with at least a first and a second opposed portion, the first and second portions being positioned, relative to one another, by an included angle of less than ninety degrees.

26. The method of claim 25, wherein providing the blade receiving member comprises machining a preform to provide the profile thereon.

27. The method of claim 25, wherein providing the blade receiving member comprises disposing a preform on at least one of the drill bit support and the body portion to provide the profile thereon.

28. The method of claim 25, further comprising moving at least a portion of the drillable body portion out of the drill bit support.

29. The method of claim 28, further comprising bending the first portion relative to the second to increase the included angle to greater than ninety degrees.

30. A method of completing a wellbore, comprising:

providing an earth removal apparatus at a lower of a drill string, the earth removal apparatus having:

first body portion; and a drillable portion disposed in the first body portion, the drillable portion including a bore;

forming the wellbore;

blocking the bore from fluid communication;

moving the drillable portion relative the first sleeve portion; and re-establishing fluid communication between an inner portion of the earth removal apparatus and the wellbore.

31. The method of claim 30, wherein blocking the bore comprises landing a ball in a ball seat disposed in the bore.

32. The method of claim 31, wherein establishing communication comprises pumping the ball through the ball seat.

33. The method of claim 30, further comprising preventing a fluid in the wellbore from entering the drill string.

34. The method of claim 30, further comprising forming a receiving profile on a bottom surface of the drillable portion.

35. The method of claim 34, further comprising providing a blade with a mating profile formed thereon by engaging receiving profile with the mating profile.

36. The method of claim 35, wherein the receiving profile includes a projection formed thereon.

37. A downhole valve, comprising:

a first body portion;

a bore disposed through the first body portion; and an obstruction member retainer at least partially disposed in the bore, the obstruction member retainer including a first seating surface and a second seating surface adapted to cooperate with an obstruction member that is movable from engagement with the first seating surface into engagement with the second seating surface, wherein the obstruction member retainer and the obstruction member interact to provide selective fluid communication through the bore.

38. The downhole valve of claim 37, further comprising a biasing member disposed inside the bore and below the obstruction member retainer.

39. The downhole valve of claim 37, wherein the obstruction member is urged into engagement with the second seating surface by the biasing member.

40. The downhole valve of claim 37, wherein the body portion comprises aluminum.

41. The downhole valve of claim 37, wherein the obstruction member retainer comprises a flexible material.

42. A downhole valve, comprising:

an obstruction member having a first position engagable with a first seating surface in an obstruction member retainer and a second position engagable with a second seating surface in the obstruction member retainer; and a biasing member biasing the obstruction member to the second position.

43. The downhole valve of claim 42, wherein the obstruction member is passable through the obstruction member retainer to the second position.

* * * * *

UNITED STATES PATENT AND TRADEMARK OFFICE

CERTIFICATE OF CORRECTION

PATENT NO. : 7,096,982 B2
APPLICATION NO. : 10/788976
DATED : August 29, 2006
INVENTOR(S) : David McKay and David M. Haugen It is certified that error appears in the above-identified patent and that said Letters Patent is hereby corrected as shown below:

On the title page:

<u>In Item (56) -- References Cited, Under U.S. PATENT DOCUMENTS:</u>

Please delete [3,545,936 A] and insert --3,548,936 A--.

Please add the following:

| | | |
|---|---|---|
| 1,981,525 | 11/1934 | Price |
| 2,324,679 | 7/1943 | Cox |
| 3,518,903 | 7/1970 | Ham et al. |
| 3,550,684 | 12/1970 | Cubberly, Jr. |
| 3,552,509 | 1/1971 | Brown |
| 3,552,510 | 1/1971 | Brown |
| 3,566,505 | 3/1971 | Martin |
| 3,570,598 | 3/1971 | Johnson |
| 4,054,332 | 10/1977 | Bryan, Jr. |
| 4,054,426 | 10/1977 | White |
| 4,064,939 | 12/1977 | Marquis |
| 4,077,525 | 3/1978 | Callegari et al. |
| 4,277,197 | 7/1981 | Bingham |
| 4,336,415 | 6/1982 | Walling |
| 4,396,077 | 9/1981 | Radtke |
| 4,489,793 | 12/1984 | Boren |
| 4,515,045 | 5/1985 | Gnatchenko et al. |
| 4,593,773 | 6/1986 | Skele |
| 4,667,752 | 5/1987 | Berry et al. |
| 4,725,179 | 2/1988 | Woolslayer et al. |
| 4,813,493 | 3/1989 | Shaw et al. |
| 4,960,173 | 10/1990 | Cognevich et al. |
| 5,022,472 | 6/1991 | Bailey et al. |
| 5,082,069 | 1/1992 | Seiler et al. |
| 5,096,465 | 3/1992 | Chen et al. |
| 5,224,540 | 7/1993 | Streich et al. |
| 5,305,830 | 4/1994 | Wittrisch |
| 5,320,178 | 6/1994 | Cornette |
| 5,323,858 | 6/1994 | Jones et al. |
| 5,477,925 | 12/1995 | Trahan et al. |
| 5,553,672 | 9/1996 | Smith, Jr. et al. |
| 5,577,566 | 11/1996 | Albright et al. |

UNITED STATES PATENT AND TRADEMARK OFFICE

CERTIFICATE OF CORRECTION

PATENT NO. : 7,096,982 B2
APPLICATION NO. : 10/788976
DATED : August 29, 2006
INVENTOR(S) : David McKay and David M. Haugen It is certified that error appears in the above-identified patent and that said Letters Patent is hereby corrected as shown below:

In Item (56) -- References Cited. Under U.S. PATENT DOCUMENTS: (cont'd)

Please add the following

| | | |
|---|---|---|
| 5,651,420 | 7/1997 | Tibbitts et al. |
| 5,813,456 | 9/1998 | Milner et al. |
| 5,836,395 | 11/1998 | Budde |
| 5,836,409 | 11/1998 | Vail, III |
| 5,890,549 | 4/1999 | Sprehe |
| 6,161,617 | 12/2000 | Gjedebo |
| 6,182,776 | 2/2001 | Asberg |
| 6,325,148 | 12/2001 | Trahan et al. |
| 6,343,649 | 2/2002 | Beck et al. |
| 6,446,723 | 9/2002 | Ramons et al. |
| 6,538,576 | 3/2003 | Schultz et al. |
| 6,622,796 | 9/2003 | Pietras |
| 2004/0112603 | 6/2004 | Galloway et al. |
| 2004/0216925 | 11/2004 | Metcalfe et al. |
| 2004/0221997 | 11/2004 | Giroux et al. |

In Section (56) -- References Cited, Under FOREIGN PATENT DOCUMENTS:

Please delete [GB 1 459 661] and replace it with --GB 1 469 661--.

Please add the following:

| | | |
|---|---|---|
| RU | 1808972 | 5/1991 |
| WO | 99/24689 | 5/1999 |
| WO | 00/11311 | 3/2000 |

In Section (56) – References Cited, Under OTHER PUBLICATIONS:

Please add the following:

YAKOV A. GELFGAT, MIKHAIL Y. GELFGAT and YURI S. LOPATIN, Retractable Drill Bit Technology – Drilling Without Pulling Out Drillpipe, Advanced Drilling Solutions Lessons From the FSU; June 2003; Vol. 2, pps. 351-464

UNITED STATES PATENT AND TRADEMARK OFFICE

CERTIFICATE OF CORRECTION

PATENT NO. : 7,096,982 B2
APPLICATION NO. : 10/788976
DATED : August 29, 2006
INVENTOR(S) : David McKay and David M. Haugen It is certified that error appears in the above-identified patent and that said Letters Patent is hereby corrected as shown below:

In Section (56) -- References Cited, Under OTHER PUBLICATIONS (cont'd)

The Original Portable Top Drive Drilling System, TESCO Drilling Technology, 1997

Editor, "Innovation Starts At The Top At Tesco," The American Oil & Gas Reporter, April, 1998, p. 65

Tessari, et al., "Casing Drilling – A Revolutionary Approach To Reducing Well Costs," SPE/IADC Paper 52789, SPE/IADC Drilling Conference, March 9-11, 1999, pp. 221-229

Forest, et al., "Subsea Equipment For Deep Water Drilling Using Dual Gradient Mud System," SPE/IADC Drilling Conference, Amsterdam, The Netherlands, February 27, 2001-March 01, 2001, 8 pages Coats, et al., "The Hybrid Drilling Unite: An Overview Of an Integrated Composite Coiled Tubing And Hydraulic Workover Drilling System," SPE Paper 74349, SPE International Petroleum Conference And Exhibition, February 10-12, 2002, pp. 1-7

Sander, et al., "Project Management And Technology Provide Enhanced Performance For Shallow Horizontal Wells," IADC/SPE Paper 74466, IADC/SPE Drilling Conference, February 26-28, 2002, pp. 1-9

Evans, et al., "Development And Testing Of An Economical Casing Connection For Use In Drilling Operations," paper WOCD-0306-03, World Oil Casing Drilling Technical Conference, March 6-7, 2003, pp. 1-10

Signed and Sealed this

Eighth Day of May, 2007

JON W. DUDAS
*Director of the United States Patent and Trademark Office*